US009858782B2

(12) United States Patent
Simmons

(10) Patent No.: US 9,858,782 B2
(45) Date of Patent: Jan. 2, 2018

(54) ALARM SYSTEM AND METHOD FOR TRIGGERING AN ALARM SIGNAL

(71) Applicants: Thomas Simmons, Berlin (DE); Anne Bandel, Berlin (DE)

(72) Inventor: Thomas Simmons, Berlin (DE)

(73) Assignees: Thomas Simmons (DE); Anne Bandel (DE)

( * ) Notice: Subject to any disclaimer, the term of this patent is extended or adjusted under 35 U.S.C. 154(b) by 0 days.

(21) Appl. No.: 15/176,197

(22) Filed: Jun. 8, 2016

(65) Prior Publication Data

US 2016/0364970 A1 Dec. 15, 2016

(30) Foreign Application Priority Data

Jun. 12, 2015 (DE) ..... 10 2015 109 404

(51) Int. Cl.
*G08B 13/14* (2006.01)
*G08B 13/24* (2006.01)

(52) U.S. Cl.
CPC ..... *G08B 13/2454* (2013.01); *G08B 13/149* (2013.01)

(58) Field of Classification Search
CPC .. G08B 13/14; G08B 13/1427; G08B 13/149; G08B 13/2417; G08B 13/2454
USPC ..... 340/572.1–572.9, 571, 539.22, 539.13, 340/539.11, 529
See application file for complete search history.

(56) References Cited

U.S. PATENT DOCUMENTS

| | | | | |
|---|---|---|---|---|
| 4,884,062 | A | 11/1989 | Lin et al. | |
| 6,049,277 | A | 4/2000 | Osame | |
| 6,133,830 | A | 10/2000 | D'Angelo et al. | |
| 6,956,480 | B2 * | 10/2005 | Jespersen | G08B 13/1427 340/539.1 |
| 7,652,573 | B2 * | 1/2010 | Donat | G08B 13/1427 340/539.32 |
| 8,467,770 | B1 | 6/2013 | Ben Ayed | |
| 2004/0155777 | A1 | 8/2004 | Mitchell et al. | |

(Continued)

FOREIGN PATENT DOCUMENTS

| | | | |
|---|---|---|---|
| DE | 60115542 | T2 | 8/2006 |
| WO | WO03100739 | A1 | 12/2003 |
| WO | WO2013132316 | A1 | 9/2013 |

*Primary Examiner* — Thomas Mullen
(74) *Attorney, Agent, or Firm* — Schmeiser, Olsen & Watts, LLP

(57) ABSTRACT

The disclosure relates to an alarm system with a portable identification device and a portable alarm device, wherein the identification device is configured to receive an enquiry signal and in reaction thereto to emit an identification signal, and the alarm device comprises: a touch-sensitive sensor device, an enquiry device, which is configured to emit the enquiry signal and to receive the identification signal, and a control device, the control device being configured: in reaction to the touch signal to emit the enquiry signal by way of the enquiry device, to compare the identification signal received as a reaction to the enquiry signal with a predefined identification in order to carry out an identity check, and to emit an alarm signal if the identity check is negative. The disclosure also relates to a method for triggering an alarm signal.

10 Claims, 4 Drawing Sheets

(56) References Cited

U.S. PATENT DOCUMENTS

| | | | | |
|---|---|---|---|---|
| 2008/0316030 | A1 | 12/2008 | Deng et al. | |
| 2012/0169496 | A1 | 7/2012 | You et al. | |
| 2013/0234853 | A1* | 9/2013 | Kazerouni ..... | G08B 13/1427 340/572.1 |

* cited by examiner

ALARM SYSTEM AND METHOD FOR TRIGGERING AN ALARM SIGNAL

CROSS-REFERENCE TO RELATED APPLICATION

This application claims priority to German Application No. 10 2015 109 404.5, having a filing date of Jun. 12, 2015, the entire contents of which are hereby incorporated by reference.

FIELD OF TECHNOLOGY

The following relates to an alarm system and a method for triggering an alarm signal.

BACKGROUND

The goal of thieves is to remove personal property, objects for example, silently and without being noticed. Previously, various technologies for preventing theft and pickpocketing have been known.

The document U.S. Pat. No. 4,884,062 discloses an alarm system for a wallet. An alarm switch comprises two electrical contacts which are arranged on two sides of the wallet. Grabbing the wallet brings the contacts together and triggers the alarm. If the owner accidentally triggers the alarm it can be switched off again via a switch.

A further alarm system is described in document U.S. Pat. No. 6,049,277. The system has two plates which are connected to each other by a cable. In the event of theft the cable is released and the alarm triggered.

Document US 2012/0169496 A1 describes a portable device with a touch-sensitive sensor. By way of the sensor a touch pattern is recorded and compared with a stored pattern. Depending on the result of the comparison an alarm is triggered.

Document WO 03/100739 A1 discloses a method of analysing the presence of objects, more particularly objects in the immediate vicinity of a user. An object to be monitored is connected to a signal emitting device. The signal emitting device produces a signal which is received by a receiver device associated with the user, more particularly his body and/or clothing. In the receiver device an output signal indicating the presence of the object is produced.

Document WO 2013/132316 A1 discloses a method of connecting objects with a virtual world in real time. A sticker is arranged on an object which can communicate wirelessly. Security against theft can be provided by way of the sticker.

Document DE 601 15 542 T2 discloses a communications unit for preventing the loss or theft of an object.

Document U.S. Pat. No. 8,467,770 B1 discloses a method and a device for securing user data on a mobile device.

SUMMARY

An aspect relates to an improved technology for the prevention of theft. In particular, in the event of a theft an alarm should be triggered quickly and reliably. The victim of the theft should be made aware of the committed or attempted theft immediately so that even the attempt at a theft can be recognised and a silent and unnoticed action by the thief prevented.

According to one aspect, an alarm system comprising a portable identification device and a portable alarm device is provided. The identification device is configured to receive an enquiry signal and, in reaction thereto, to emit an identification signal. The alarm system comprises: a touch-sensitive sensor device which is configured to record and convert a touch into an electrical touch signal, an enquiry device, which is configured to emit the enquiry signal and to receive the identification signal, and a control system, which is connected to the sensor system and enquiry system through data technology. The control system is configured to emit the enquiry signal by the enquiry device as a reaction to the touch signal, to compare the identification signal received as a reaction to the enquiry signal with a predefined identification in order to perform an identity check, wherein the identity check is positive if the received identification signal corresponds with the predefined identification and wherein the identity check is negative if the received identification signal does not correspond with the predefined identification or if an identification signal is not received within a predetermined period of time, and to emit an alarm signal if the identity check is negative.

According to another aspect, a method for triggering an alarm signal is disclosed. The method involves the following steps: providing a portable identification device and a portable alarm system, recording a touch by means of a touch-sensitive sensor device which is provided in the alarm system, and emitting an enquiry signal by means of an enquiry device provided in the alarm system, performing an identity check by means of a control device arranged in the alarm system, wherein the identity check is positive if the received identification signal corresponds with the predefined identification and wherein the identity check is negative if the received identification signal does not correspond with the predefined identification or if an identification signal is not received within a predetermined period of time, and emitting an alarm signal by way of the control device if the identity check is negative.

In contrast to previous technologies, the alarm device already recognises touching of the object to be protected and differentiates whether this touch is admissible or inadmissible in order to trigger an alarm in the event of inadmissible touching.

The alarm system has two components, the portable identification device and the portable alarm device, which can be spatially separate from each other. The enquiry device and the identification device can be configured to wirelessly emit and receive the enquiry signal and the identification signal, respectively.

The alarm device can be provided in an object to be protected, for example in a wallet, a purse, a handbag, a suitcase or equivalent. The sensor device records touching of the object. If in relation to the touch an incorrect or no identification signal is received the alarm device triggers the alarm signal. The sensor device can be arranged in the object in such a way that it records any touches on the entire surface of the object.

The identification device emits an identification signal which positively identifies a user of the identification device, and thereby of the alarm system, as being entitled to touch the object (known as the authorised user). The identification device can, for example, be arranged in a ring, an armband or a watch. The range of the identification device can be short (a few centimetres), for example 50 cm, 10 cm or 1 cm.

One possible case of application of the alarm system is as follows: the alarm device is arranged in a wallet is such a way that the sensor device covers a part or the entire inner surface of the wallet. Through this, the outer surface of the wallet is sensitive to touching, which means that a touch on the outer side of the wallet is recorded by the sensor device. The identification device is arranged in a ring which the user is wearing on a finger. To use the wallet the user reaches for it. The touch is recorded by the sensor device. In reaction to the enquiry signal the identification device emits an identification signal which is received by the enquiry device. The control device compares the received identification signal with a predefined identification. If the comparison is positive the touch is considered as authorised and no alarm signal is emitted. The authorised user (i.e. the legal owner) can continue using the wallet normally without triggering an alarm or in any way without having to do anything differently in daily use. If a thief now grasps the wallet, this touch is also recorded. If, for example, the identification device of the authorised user is too far away so that his/her identification is not received by the enquiry device, after a predetermined period of time has elapsed the alarm device triggers the alarm. Even if the thief were to have his own identification device, but which emits an incorrect identification, this contact also counts as unauthorised and the alarm device triggers the alarm as the touch occurred without an authorised accompanying identification signal. This allows the immediate recognition of a theft and an instant reaction thereto.

Even before removal of the stolen object by the thief, even in the event of a light touch the device emits an alarm, for example a loud acoustic signal and/or flashing lights, which is maintained in the event of removal of the object from the user and general attention is thus attracted. If the thief makes off with the stolen object the alarm continues to be emitted which facilitates pursuit of the thief. In addition to being able to pursue the thief, this also helps in finding the object if the thief were to throw it away or hide it.

Through suitable selection of the sensor the device also triggers an alarm signal if the thief wears gloves or uses a tool, such as pliers or tweezers.

The predefined identification can, for example, be stored in a memory of the alarm device. Several identifications can be stored. The control device can be configured to compare the received identification signal with several stored identifications in order to perform the identity check.

The sensor device can be configured to record several touches and convert them into electrical touch signals. The control device can be configured to evaluate the touch signal of the sensor device in that it differentiates one (or more) actual touches from other signals. Through this a "genuine" touch by a person can be distinguished from a touch with other objects. A capacitive proximity sensor can be used for example. For the capacitive proximity sensor the natural frequency of an electrical oscillating circuit can be evaluated or the time for charging a capacitor can be determined.

The predetermined time period can, for example, be 0.5 seconds, 0.1 seconds or 0.01 seconds.

According to one form of embodiment the sensor device can be designed as a capacitive sensor device and have a sensor element that is operated with a suitable power supply (e.g. a voltage source) and evaluated. Measuring with a capacitive sensor utilises the fact that the electrical capacitance between electrodes changes with the relative permittivity of the medium between them, e.g. when placing a human hand in their immediate vicinity. This change in capacitance can be measured and evaluated. A capacitive sensor is known per se and will not be described in more detail.

The sensor element can be flat. The flat sensor element can be arranged underneath a surface of the object to be protected in such a way that at least one part of the inner side of the surface is covered by the flat sensor element so that the outer side of the object to be protected is sensitive to touch. It can be envisaged that the entire inner side of the surface of the object is covered by the flat sensor element so that the entire outer side is sensitive to touch. The greater the portion of sensitised surface the greater the possibility of recording a touch. The sensor element can be made of metal, for example a metal foil or a metal grid. Suitable metals are copper and aluminium for example. Other suitable materials for the sensor element are electrically conductive plastics, polymers and lacquers, wherein these materials can also be used in the form of a film or a grid. The other components of the alarm device can be arranged in different areas of the object.

The enquiry device can be designed as an RFID enquiry device, and the identification device can be designed as an RFID transponder. The enquiry device can be configured to send an enquiry signal to the identification device and to receive the response of the identification device to the enquiry signal as an identification signal. An RFID system (RFID—radio-frequency identification) consists of a transponder which is located on or in an object and has an identifying code as well as an enquiry device for reading out this identification. The identification device can be designed as a passive RFID transponder. In this case the energy supply of the identification device is provided with the enquiry signal.

The identification device and the enquiry device can be configured to communicate with each other in an encrypted manner. The enquiry device can produce an encrypted enquiry signal and transmit it to the identification device. The identification device can respond to the encrypted enquiry signal with an encrypted identification signal. For this disposable codes can be used. With the enquiry signal the enquiry device can request a key value, for example a particular value of a code number. The value and code number can be made available in the form of a list. The identification device then seeks the corresponding value and transmits this value with the identification signal (similarly to the TAN process in online banking). Alternatively or additionally, asymmetrical encoding with private and public keys can be used. Encoding can also be used if the enquiry device is in the form of an RFID enquiry device and the identification device is an RFID transponder.

The control unit can also be configured to emit a trigger signal if the identity check is positive. The alarm system can, for example, comprise a locking device or be connected to such a device. The locking device can be in the form of an electrical locking device. The locking device can be unlocked by means of the trigger signal. For example, the locking device can be arranged on, and lock, a door, a wallet, a piece of luggage or a halter. In the case of authorised touching (positive identification) the lock can be unlocked, i.e. the door or the halter, for example, is opened. In the event of unauthorised touching (negative identification) the locking device remains closed and the alarm signal is triggered.

The alarm system can comprise several identification devices, wherein each identification device can have its own individual identification, and the control device is configured that only this individual identification signal is considered as authorised for it. In this way the best possible security against manipulation is guaranteed.

Several identification devices and a single alarm device can be provided and configured with a single identification. The user of the alarm device can thereby optionally use various identification devices.

Several alarm devices can be configured so that for them the same identification is considered as authorised. The user can thus use the same identification device for various alarm devices.

Several alarm devices can be configured so that for each one several identifications are considered as authorised. Various individual identification devices can thus be used with a single alarm device.

It can be envisaged that the control device is configured to emit the alarm signal in the form of an acoustic signal, an optical signal and/or a haptic signal. An acoustic signal can be generated and reproduced by means of a sound transducer arranged on the alarm device, for example by means of a ferroelectric loudspeaker (piezo loudspeaker). Various optical signals can be displayed. When the alarm device is in operation an optical stand-by signal can be shown, a green flashing light for example. If a touch is recorded with an assigned identification signal, an optical recording signal can be shown, for example, a steady green light for a certain period. This signals that the touch is authorised. In the event of a touch without an identification signal an optical alarm signal can be displayed to warn the owner, for example in the form of a steady or flashing red light. A haptic signal can be emitted in the form of a vibration of the alarm device.

The control device can be configured to stop emitting the alarm signal when an identification signal is received and the identity check is positive. If the alarm is accidentally triggered, for example through an acquaintance of the user touching the alarm device, the user can stop the alarm signal being emitted through his or her identification signal. For this the user can bring the identification device into the vicinity of the alarm device so that the identification signal can be received.

The alarm device can have a power supply device which is connected to the components of the alarm device and supplies these with electrical energy. The power supply device can be a primary cell or a secondary cell. The components of the alarm device can be designed as individual modules or be produced as an integrated component.

It can be envisaged that the identification of an identification device and the configuration of an alarm device can be individually realised.

The features disclosed for the alarm device can be implemented analogously in the method. Equally, features disclosed for the method can be implemented in an analogous manner in the device.

BRIEF DESCRIPTION

Some of the embodiments will be described in detail, with reference to the following figures, wherein like designations denote like members, wherein.

Below, for the same components/method stages the same reference numbers are used.

DETAILED DESCRIPTION

Figure 1:
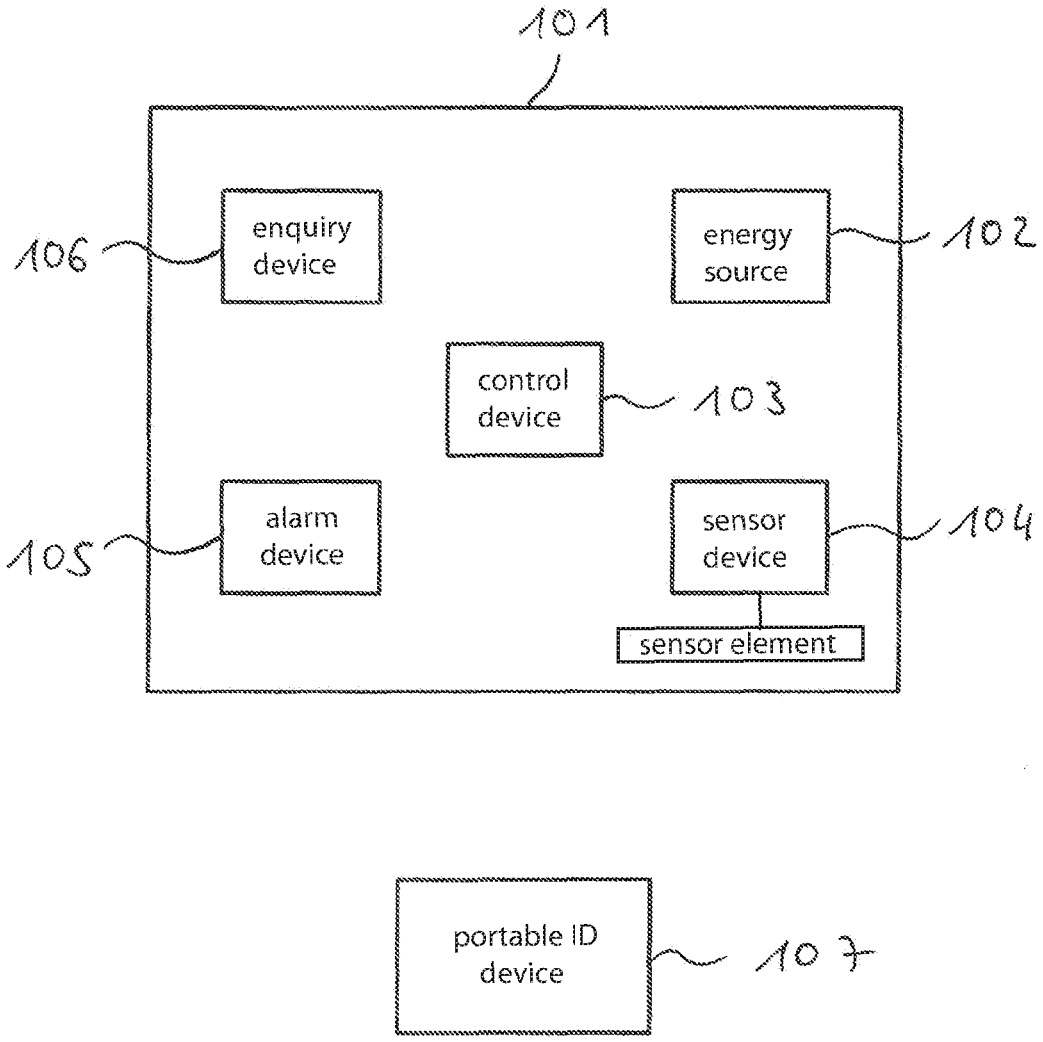
FIG. 1 shows a schematic view of an alarm system.

FIG. 1 shows a view of an alarm system with a portable alarm device 101 and a portable identification device 107. The alarm device 101 has an energy source 102, a control device 103, a sensor device 104, an alarm device 105 and an enquiry device 106. The energy source 102 supplies the components with electrical power. It can be designed as a battery (primary cell) or rechargeable battery (secondary cell). The sensor device 104 is configured to record a touch and convert it into an electrical touch signal. The sensor device 104 can be a capacitive sensor device with a flat sensor element. The sensor element can be arranged in an object to be protected underneath the surface of the object in such a way that the inner side of the surface is partially or fully covered by the flat sensor element. The enquiry device 106 (e.g. an RFID enquiry device) is configured to emit an enquiry signal and to receive an identification signal which is emitted by the identification device 107 (e.g. an RFID transponder) in reaction to the enquiry signal. The control device 103 is connected to the other components and configured to emit an alarm signal if a touch is recorded and an identity check is negative. The control device can be a microcontroller. The alarm device 105 emits the alarm signal. The alarm device 105 can have a sound transducer, for example a piezo loudspeaker and/or an optical display, for example a lamp (LED or OLED).

Figure 2:
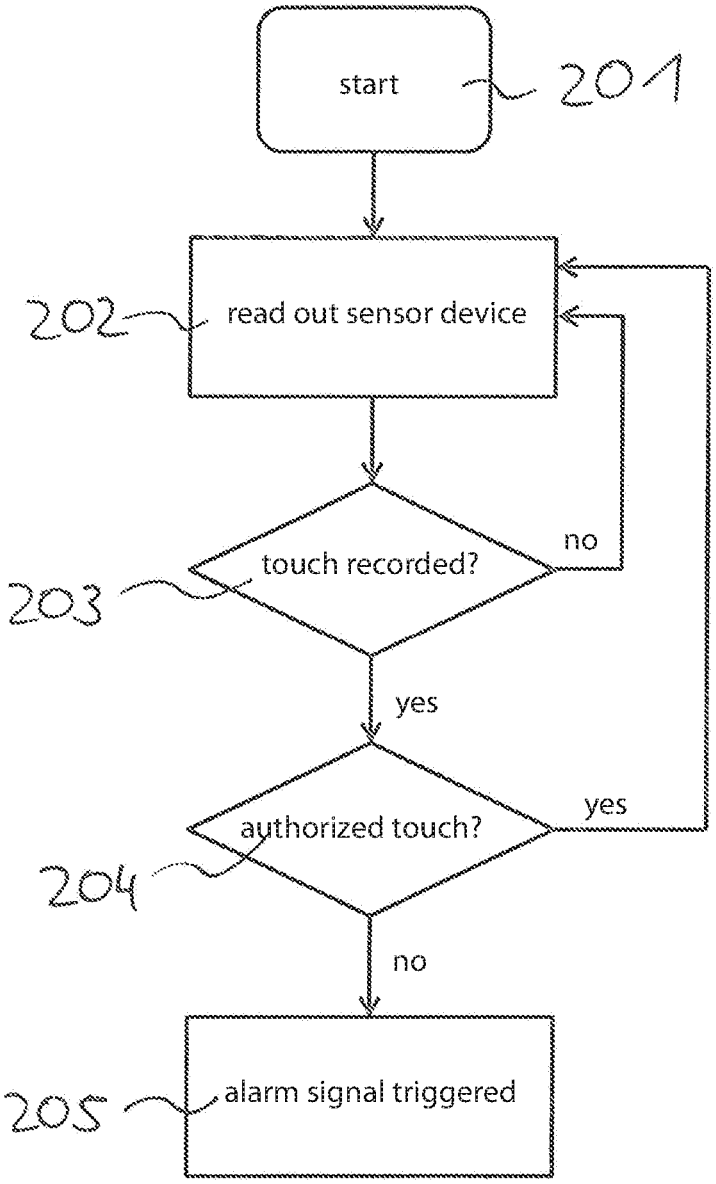
FIG. 2 shows a flow diagram of a method for triggering an alarm signal.

An embodiment of a method is shown in FIG. 2. The method begins with step 201 ("Start"). The sensor device 104 is read out (step 202). In step 203 it is determined by the sensor device whether a touch is recorded. If no touch is recorded, reading out is repeated (step 202). If a touch is recorded, in step 204 it is checked whether an identification signal has been received which authorises the touch, i.e. the received identification signal corresponds with a pre-defined identification (identity check). If the check is positive (an authorised touch is involved), reading out of the sensor device is repeated in step 202. If the identification signal has not been received within a predetermined period of time (for example within 0.1 second) or if the received identification signal does not correspond with the predefined identification, an alarm signal is triggered in step 205.

Figure 3:
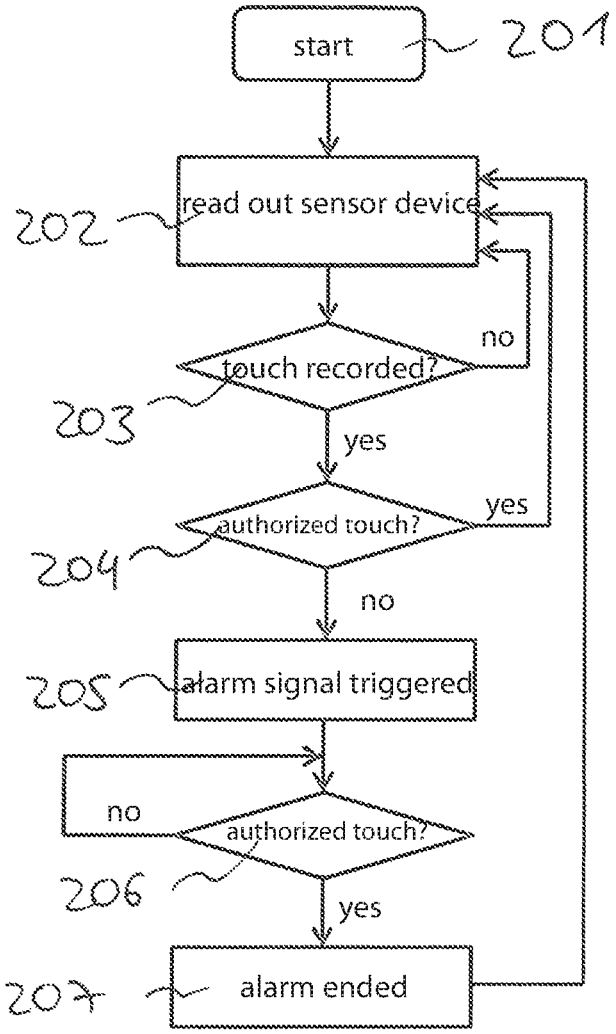
FIG. 3 shows a flow diagram for a further form of embodiment of the method.

The method shown in FIG. 3 is an expansion of the method according to FIG. 2. It is envisaged that after triggering of the alarm an identity check is carried out again (step 206). If this is positive the alarm is ended (stage 207). If the check is negative the alarm remains active and the check is repeated.

Figure 4:
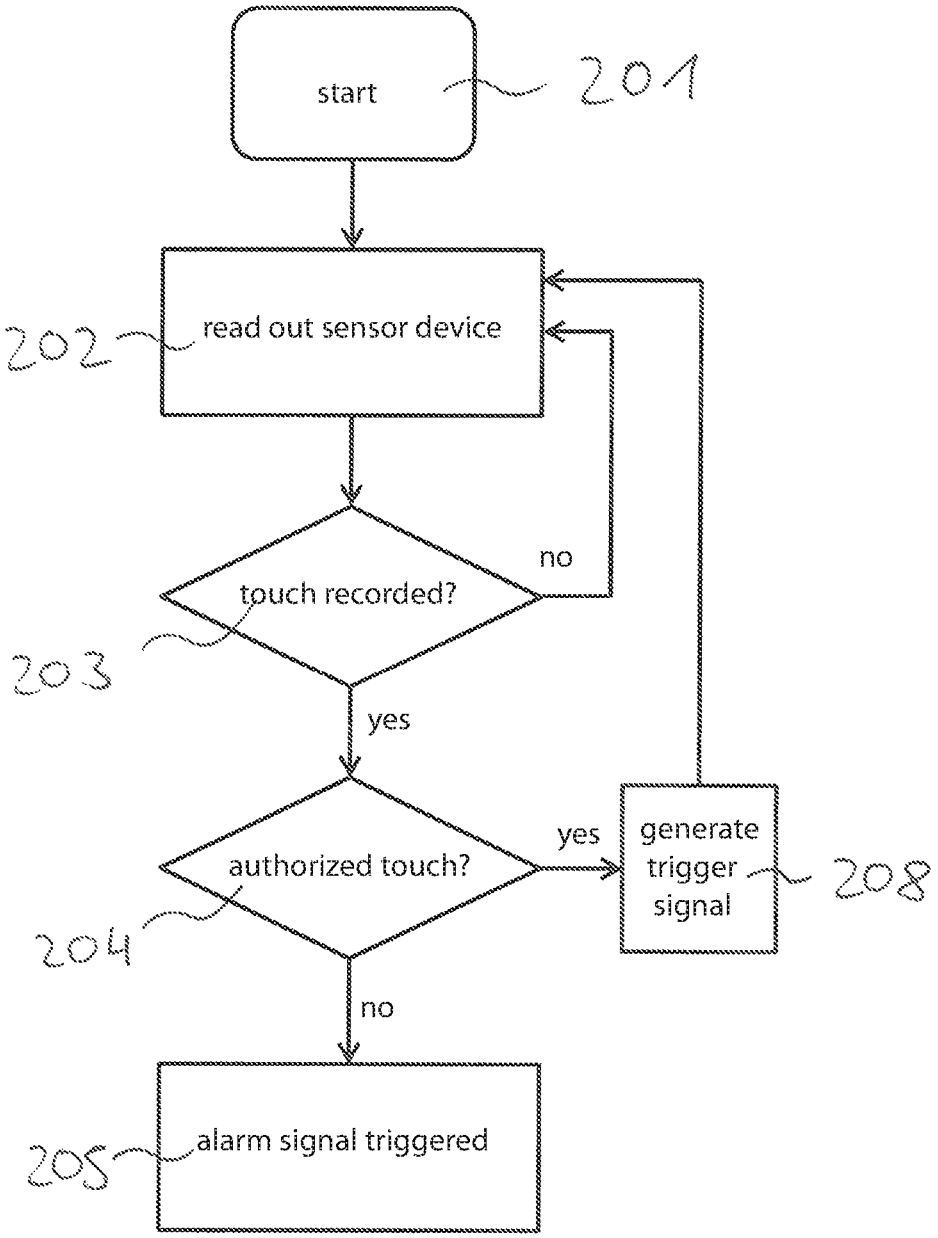
FIG. 4 shows a flow diagram for a yet a further form of embodiment of the method.

FIG. 4 shows a further embodiment which builds on the method known from FIG. 2. If the identity check in step 204 is positive, a trigger signal is generated and emitted (step 208). The trigger signal can, for example, release a lock. If the result of the identity check is negative the alarm signal is emitted.

Not shown, but applicable for all forms of embodiment is encrypted communication between the enquiry device 106 and the identification device 107.

For form of embodiment, the features disclosed in the description, the claims and the figures can be of relevance in any combination with each other.

The invention claimed is:

1. An alarm system comprising:

a portable identification device and a portable alarm device, wherein:

the portable identification device is configured to receive an enquiry signal and to emit an identification signal in reaction thereto, and the portable alarm device includes:

a touch-sensitive sensor device, which is configured to record a touch and convert the touch into an electrical touch signal, an enquiry device, which is configured to emit the enquiry signal and to receive the identification signal, and a control system, which is connected to the touch-sensitive sensor device and enquiry device;

wherein the control system is configured to;

emit the enquiry signal by the enquiry device in reaction to the touch signal, compare the identification signal received in reaction to the enquiry signal with a predefined identification, perform an identity check, wherein the identity check is positive if the received identification signal corresponds with the predefined identification and wherein the identity check is negative if the received identification signal does not correspond with the predefined identification or if an identification signal is not received within a predetermined period of time, and emit an alarm signal if the identity check is negative.

2. The alarm system according to claim 1 wherein the predetermined period of time is less than 0.5 seconds.

3. The alarm system according to claim 1 wherein the touch-sensitive sensor device is designed as a capacitive sensor device and has a sensor element configured to connect to a voltage source.

4. The alarm system according to claim 3 wherein the sensor element is flat.

5. The alarm system according to claim 1 wherein the enquiry device is an RFID enquiry device and the identification device is an RFID transponder.

6. The alarm system according to claim 1 wherein the identification device and the enquiry device are configured to communicate with each other in an encrypted manner.

7. The alarm system according to claim 1 wherein the control system is further configured to emit a trigger signal if the identity check is positive.

8. The alarm system according to claim 1 wherein the control system is configured to emit the alarm signal in the form of an acoustic signal, an optical signal and/or a haptic signal.

9. The alarm system according to claim 1 wherein the control system is configured to stop emitting the alarm signal when an identification signal is received and the identity check is positive.

10. A method for triggering an alarm signal comprising:

providing a portable identification device and a portable alarm device, the portable identification device emitting an identification signal in response to receiving an enquiry signal, recording a touch by a touch-sensitive sensor device which is provided in the portable alarm device, and emitting the enquiry signal by an enquiry device provided in the alarm device, performing an identity check by a control device provided in the alarm device, wherein the identity check is positive if the received identification signal corresponds with a predefined identification and wherein the identity check is negative if the received identification signal does not correspond with a predefined identification or if an identification signal is not received within a predetermined period of time, and emitting an alarm signal by the control device if the identity check is negative.

* * * * *